United States Patent [19]

Brandi

[11] 4,311,396

[45] Jan. 19, 1982

[54] TRUCK MIXER

[75] Inventor: Alfredo Brandi, Dogana, San Marino

[73] Assignee: Compagnia Italiana Forme Acciaio S.p.A., Milan, Italy

[21] Appl. No.: 61,865

[22] Filed: Jul. 30, 1979

[30] Foreign Application Priority Data

Aug. 9, 1978 [IT] Italy ..... 26617 A/78

[51] Int. Cl.[3] ..... B28C 5/20; B28C 5/42; B28C 7/16

[52] U.S. Cl. ..... 366/51; 366/54

[58] Field of Search ..... 366/62, 63, 68, 44, 366/51, 27, 28, 29, 42, 43, 54, 60, 61; 417/900; 137/615

[56] References Cited

U.S. PATENT DOCUMENTS

| | | | |
|---|---|---|---|
| 2,859,949 | 11/1958 | Willard | 366/68 X |
| 3,019,002 | 1/1962 | Prichard | 366/62 |
| 3,507,347 | 4/1970 | Bennett | 417/900 X |
| 3,685,543 | 8/1972 | Schwing et al. | 137/615 |
| 4,130,134 | 12/1978 | Castle | 366/68 X |
| 4,154,534 | 5/1979 | Lawrence et al. | 366/44 X |
| 4,212,542 | 7/1980 | Beekenkamp | 366/54 |

*Primary Examiner*—Philip R. Coe

*Attorney, Agent, or Firm*—Stevens, Davis, Miller & Mosher

[57] ABSTRACT

A truck mixer allowing the operator to carry out direct visual control of the loading and unloading operations of the concrete, has the concrete mixer mounted on the truck with its loading and unloading mouth located at the forward portion of the vehicle chassis and arranged substantially above the driver's cab, forward of and below which cab the concrete pumping device for the distribution arm and the associated collecting tank are mounted.

3 Claims, 3 Drawing Figures

TRUCK MIXER

BACKGROUND OF THE INVENTION

The present invention relates to a truck mixer, the improved and original design of which allows the driver to carry out direct visual control of the loading and unloading operations of the concrete and consequently provides for better utilisation of the means and of the personnel employed.

SUMMARY OF THE INVENTION

Basically, the truck mixer according to the invention, of the type in which the concrete mixer is able to discharge the concrete mix processed in it for external use, in a direct manner through a chute having a channel, which can be orientated and inclined or, alternatively, inside the collecting tank of a concrete pumping device which feeds an articulated and orientable delivery arm, is characterized in that the concrete mixer is mounted on the vehicle chassis in such a way that its loading and unloading mouth is located at the forward portion of the vehicle chassis and is arranged substantially above the driver's cab, forward of and below which cab the concrete pumping means for the distribution arm and the associated collecting tank are mounted.

In this truck mixer, the controls which cause the operation of the various components (concrete mixer, pump, arm, chute and so on) are centralized hydraulic controls which are mounted in the driver's cab, within easy reach of the driver.

BRIEF DESCRIPTION OF THE DRAWINGS

The invention will now be described in greater detail purely by way of example, with reference to the attached drawing which shows one preferred embodiment and in which.

DESCRIPTION OF THE PREFERRED EMBODIMENT

Figure 1:
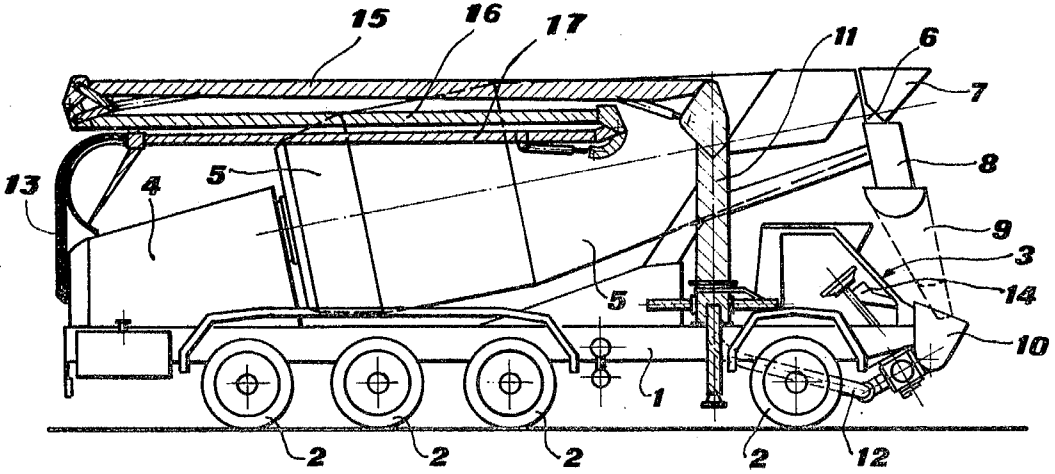
FIG. 1 is a side view of the truck mixer according to the invention.
Figure 2:
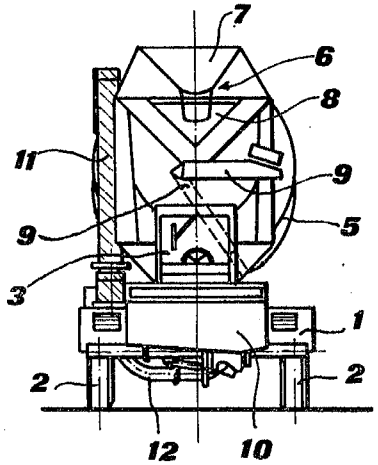
FIG. 2 is a front view of the truck mixer shown in FIG. 1.
Figure 3:
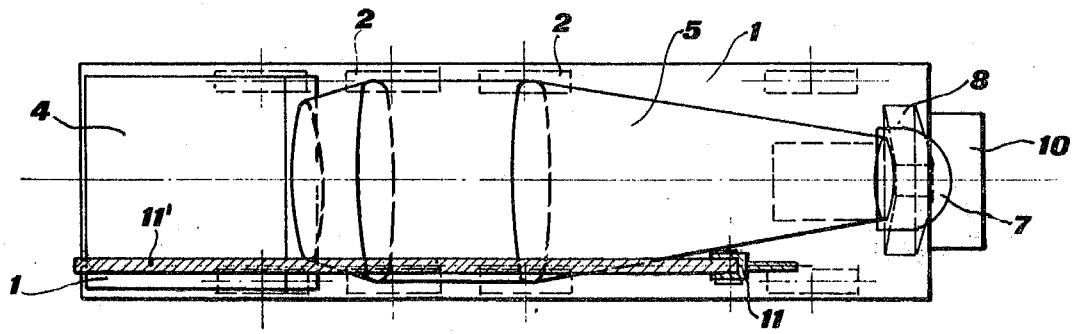
FIG. 3 shows a top view, in plan, of the truck mixer of FIGS. 1 and 2.

With reference to the drawing, the truck mixer according to the invention comprises a vehicle chassis 1 on wheels 2 having a forward driver's cab 3 and rear motor unit 4.

According to the invention the concrete mixer 5 is mounted on the chassis 1 with its loading and unloading mouth 6 orientated at the front portion (instead of at the back as was the case with all designs known up till now) of the vehicle chassis and arranged above the driver's cab 3.

As is normally the case, there are further provided, close to mouth 6 of the concrete mixer 5, a loading hopper 7 and an unloading hopper 8 from which the concrete mix in the concrete mixer 5 can be directed, via a chute having a channel 9, directly to the outside, or alternatively, to a pump 10 for the concrete.

All these components are located, in a manner which is completely original, at the forward portion of the truck mixer, under the eyes of the driver when he is seated at his place in the driver's cab.

The truck mixer further includes an orientable articulated arm, of a type known per se, comprising a column 11 fixed to chassis 1 and three articulated parts 15, 16 and 17 which are joined to column 11 and which are supplied through a tube 12 from the pump 10 for the concrete. Reference numeral 13 indicates the delivery tube of this articulated arm.

Operation and/or control of the concrete mixer 5, of hopper 7 and 8, of chute 9 and of articulated arm 11 are produced using suitable motor means of a known type which are installed in the motor unit 4 together with the engine for driving the chassis of the vehicle 1 and are coordinated using hydraulic controls which are centralized in the driver's cab within easy reach of the driver of the truck mixer, and are brought together in a panel 14.

This particular arrangement makes it possible for the driver, without leaving his driver's cab or leaving the place where he carries out his work, to carry out command of the loading of the concrete mixer and command and control of unloading, whether this be directly through the chute 9, or indirectly through the articulated arm 11, this all being done while there is direct and immediate visual checking of operations. The driver can consequently follow the operations very effectively and comfortably, with clear advantage both as regards making the best use of the means and his own time (and consequently productivity) and also with a degree of accuracy and safety which are both considerably greater than is the case with conventional equipment.

It is intended that the truck mixer which has been illustrated and described can also take different forms, by introducing variations and modifications into it which will be obvious to those skilled in the art, without however departing from the scope of the invention.

I claim:

1. Truck mixer designed to allow the operator to carry out direct visual control of the loading and unloading operations of the concrete, of the type in which the concrete mixer is able to discharge the concrete mix processed in it for external use in a direct manner comprising a truck, a driver's cab mounted on the front end of the truck, a mixer mounted on said truck having a loading and unloading mouth mounted above said cab, a concrete collecting tank mounted in front of and below said cab, a chute having a channel communicating with said mouth to discharge concrete either to said concrete collecting tank or to the job, a pumping device mounted on the front of said truck below said cab to receive concrete from said tank, an articulated and orientable arm mounted on said truck and delivery tube mounted on said arm to receive concrete from said pumping device.

2. Truck mixer according to claim 1 including controls governing the operation of the various components mounted in the driver's cab, within easy reach of the driver.

3. Truck mixer according to claim 1 including motor means which provide for driving of the concrete mixer and the operation of the various components located at the rear portion of the truck mixer.

* * * * *